US005575008A

United States Patent [19]

McBride et al.

[11] Patent Number: 5,575,008

[45] Date of Patent: Nov. 19, 1996

[54] MARTIAL ARTS TRAINING GLOVE

[76] Inventors: Robert L. McBride, 550 Dumfries, Detroit, Mich. 48217; Bascom E. Copley, 13987 Glenwood Dr., Shelby Township, Mich. 48315

[21] Appl. No.: 558,788

[22] Filed: Nov. 16, 1995

[51] Int. Cl.[6] ..... A41D 19/00

[52] U.S. Cl. ..... 2/161.1; 2/159

[58] Field of Search ..... 2/161.1, 161.4, 2/159, 160, 161.2, 161.5; 482/105, 44, 47, 48, 55, 93

[56] References Cited

U.S. PATENT DOCUMENTS

| | | | |
|---|---|---|---|
| 4,247,097 | 1/1981 | Schwartz | 482/105 |
| 4,575,075 | 3/1986 | Tarbox et al. | 482/105 |
| 4,684,123 | 8/1987 | Fabry | 482/105 |
| 4,813,079 | 3/1989 | Reitzel | 2/160 |
| 4,911,433 | 3/1990 | Walker et al. . | |
| 5,300,000 | 4/1994 | Schwartz | 482/105 |
| 5,468,200 | 11/1995 | Hoffman | 482/105 |

FOREIGN PATENT DOCUMENTS

| | | | |
|---|---|---|---|
| 97224 | 6/1924 | Germany | 482/105 |

*Primary Examiner*—C. D. Crowder
*Assistant Examiner*—Gloria Hale
*Attorney, Agent, or Firm*—Peter D. Keefe

[57] ABSTRACT

A martial arts training glove that provides protection of the trainee's hand from possible hurt during hand strike exercises, including a glove body, wherein the finger and thumb receptacles are truncated. The glove body is provided with one or more sealed compartments which are filled to more-or-less about 95% capacity with loose grains, preferably spherical and nondeformable grains such as steel shot. The compartments are located with respect to the glove body so that the grains within the compartments protect the trainee's hand from hand strikes, particularly the five common martial arts hand strikes enumerated hereinabove. The preferred compartment locations are (with respect to a hand fitted thereinside): the heel of the palm, the bottom of the hand, the front and back of the index and near index knuckles, and the index finger metacarpus bone. Preferably, the compartments are located and sized so that there is provided an a balanced weight distribution symmetry of the grains with respect to the glove body which thereby allows for hand movements without impairment. A preferred material for the glove body is leather.

19 Claims, 4 Drawing Sheets

MARTIAL ARTS TRAINING GLOVE

BACKGROUND OF THE INVENTION

1. Field of the Invention

The present invention relates to the martial arts and more particularly to hand strikes and hand movements associated therewith. More particularly, the present invention relates to a glove that is worn by a person practicing martial arts hand strikes, wherein the glove serves to protect the person's hand from possible hurt due to hand strike impact, 2. Description of the Prior Art The martial arts have become increasingly popular not only because the martial arts provide excellent and proven self defense techniques, but because the martial arts develop the spirit, mind and body of the practitioner. With regard to the former, the martial arts enable the practitioner with ability to evade the advances of an attacker, while also enabling the practitioner to administer strikes to the attacker which are appropriate to the dangers of the encounter. With regard to the latter, the martial arts serve to put the body in tune with the mind, master control of the body, increase mental concentration, and uplift the spirit. Thus, it is no wonder that the martial arts are receiving wide spread attention from people everywhere.

One of the key aspects of martial arts mastery is the ability of the practitioner to adroitly effect hand movements and hand strikes. There are five common hand strikes: 1) the "front knuckle hand strike" involving frontal impact with the index and near index knuckles (see FIG. 8); 2) the "back fist hand strike" involving a rolling movement and an impact with the aforementioned knuckles at the back of the hand (see FIG. 9); 3) the "pseudo ridge hand strike" involving an impact with the metacarpus bone of the index finger (see FIG. 11); 4) the "open palm hand strike" involving impact at the heel of the palm (see FIG. 13); and 5) the "ridge hand strike" involving an impact with the bottom of the hand (see FIG. 15). These hand strikes require simultaneous mental concentration and physical ability. Further, it is a generally accepted principle that these hand strikes should not be practiced in earnest until the hand has built-up enough muscle so as to prevent injury; presumably, too, by the time muscle has been built-up the confidence of the trainee has increased commensurately.

Problematically, a trainee in the martial arts must take a long time to build-up the necessary muscle tissue, which serves as an impediment to moving ahead with training as fast as would otherwise be possible. Accordingly, what is needed in the relevant art is some way to provide protection of the trainee's hand from possible hurt during hand strike exercises so that confidence is always at peak.

SUMMARY OF THE INVENTION

The present invention is a martial arts training glove that provides protection of the trainee's hand from possible hurt during hand strike exercises so that confidence is always at peak while hand movements and hand strikes are learned without the necessity of first acquiring a built-up hand.

The martial arts training glove according to the present invention provides either and/or both a right and a left hand glove for the hands of a trainee of the martial arts. Each martial arts training glove includes a glove body, wherein the finger and thumb receptacles are truncated above the first knuckle and generally adjacent the second knuckle. The glove body is provided with one or more sealed compartments which are filled to more-or-less about 95% capacity with loose granulated material, preferably being substantially nondeformable metallic grains. The compartments are located with respect to the glove body so that the grains within the compartments protect the trainee's hand from hand strikes, particularly the five common martial arts hand strikes enumerated hereinabove. The preferred compartment locations are (with respect to a hand fitted thereinside): the heel of the palm, the bottom of the hand, the front and back of the index and near index knuckles, and the index finger metacarpus bone. The compartments are located and sized so that there is provided a balanced weight distribution symmetry of the grains with respect to the glove body along an axis Ax of rotation defined along the trainee's forearm, which thereby allows for balanced hand movements by the trainee when wearing the martial arts training glove; this is particularly important in rolling hand movements associated with the martial arts, such as that associated with the "back fist hand strike" . A preferred material for the glove body is leather.

In operation, a trainee places his or her hand into the glove and then proceeds to train. Because the fingers and thumb receptacles are truncated, finger and thumb hand strike configurations are not impeded by the glove body. Further, because the grains are strategically placed to shieldingly protect the trainee's hand during hand strikes, the trainee will have a very high level of confidence all during the training.

Accordingly, it is an object of the present invention to provide a martial arts training glove which provides protection for the hand of a trainee who is learning martial arts hand strikes.

It is an additional object of the present invention to provide a martial arts training glove which does not impede the trainee to assume appropriate wrist, hand, finger and thumb postures.

It is another object of the present invention to provide a martial arts training glove which has loose granular material distributed therein for providing freedom from possible hurt during hand strikes, yet the weight of the granular material is symmetrically balanced with respect to the glove body so as not to adversely affect hand movements associated with hand strikes.

It is a further object of the present invention to provide a martial arts training glove which serves to protect the trainee from hand impact injury, wherein the glove is durable, reliable and attractive.

It is yet another object of the present invention to provide a martial arts training glove which is weighted having a symmetric weight distribution for developing tendons and muscles used in movements associated with the martial arts.

These, and additional objects, advantages, features and benefits of the present invention will become apparent from the following specification.

DETAILED DESCRIPTION OF THE PREFERRED EMBODIMENT

Figure 1:
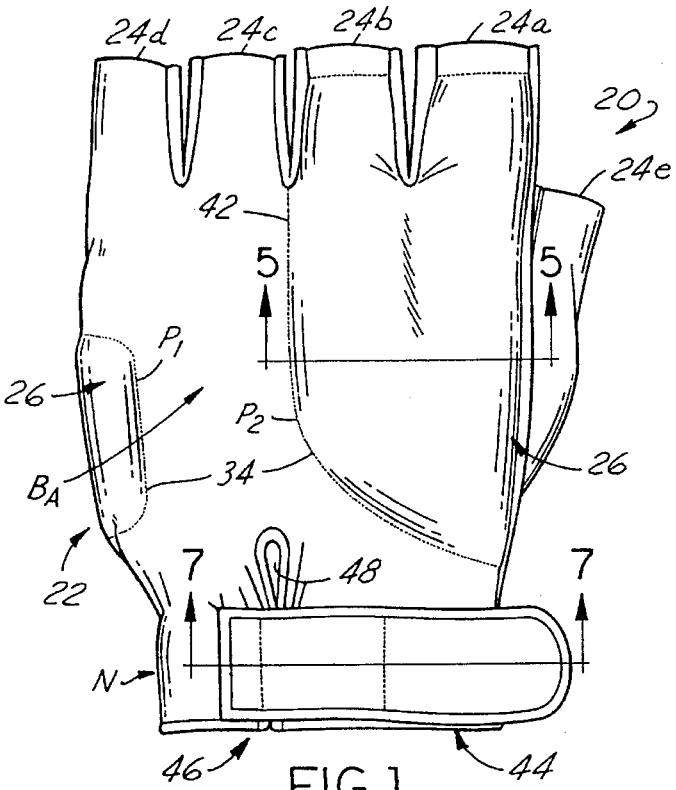
FIG. 1 is a back side view of the martial arts training glove according to the present invention.
Figure 2:
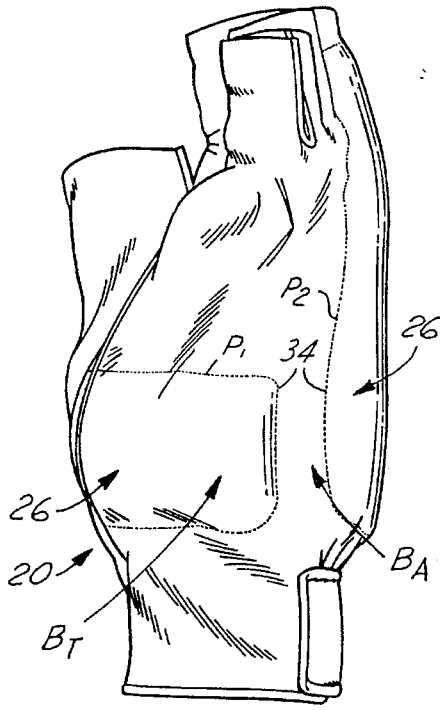
FIG. 2 is a bottom side view of the martial arts training glove according to the present invention.

Referring now to the Drawing, FIGS. 1 through 7 generally depict the martial arts training glove 20 according to the present invention. The martial art training glove 20 includes a glove body 22, wherein the index finger receptacle 24*a*, near (or second) index finger receptacle 24*b*, third finger receptacle 24*c*, fourth finger receptacle 24*d* and thumb receptacle 24*e* have each been truncated; and further includes compartments 26 for retaining therein a large number of small diameter grains 28 (see FIGS. 5 and 6). The size and location of the compartments 26 are preselected for providing protection to a wearer who is performing preselected martial arts hand strikes.

The martial arts training glove 20 is preferably constructed generally akin to that of a conventional glove, except for the modification wherein the finger and thumb receptacles 24*a*, 24*b*, 24*c*, 24*d*, 24*e* are truncated and the grain filled compartments 26 are provided. A preferred material of construction of the glove body 22 is leather, but other glove materials can be used, such as for example vinyl. The truncation of the finger and thumb receptacles is preferably located so that the receptacles terminate adjacent to the second finger and thumb knuckles 30, wherein the second knuckles are exposed when flexed (see FIG. 10). For a medium sized glove body 22, the finger and thumb receptacles are truncated so as to be preferably about 1 inch in length.

It is preferred to provide two compartments 26, a palm side heel compartment 26*a* and a back side compartment 26*b*. By appropriately dimensioning the palm side heel and back side compartments 26*a*, 26*b*, the hand 25 of a trainee is protected with respect to at least the five common martial arts hand strikes enumerated hereinabove, as will be further discussed in detail hereinbelow with respect to FIGS. 8 through 16. The compartments 26 are sealed closed sack-like structures which are preferably composed of a cloth-like material 32 which is appropriate for lining the inside of a glove and connected with the interior side I of the glove body 22 via sewing 34 (see FIGS. 5 and 6), and is also able to retain the grains 28 therewithin. The compartments 26 are preferred to be subdivided by sewn seams 36. The subdivisions 38 formed by the seam 36 provide distributive control over movement of the grains 28 so that the compartments 26 remain properly filled throughout with the grains. The palm side heel compartment 26*a* has a first perimeter $P_1$ and the back side compartment 26*b* has a second perimeter $P_2$. As shown by Figures 1 through 6, the perimeters $P_1$, $P_2$ are connected to the interior side I of the glove body 22 by the sewing 34, while the seam 36 does not connect with the glove body.

With respect to the grains 28, the preferred composition thereof is a loose granular material, preferably composed of a nondeformable metallic grains or particles, such as for granulated steel shot having a more-or-less spherical shape. The preferred size of the grains 28 is based upon provision that there be a large number of grains across the thickness T of the compartments, that the grains be movable in relation to one another and that the grains tend toward an even distribution within the compartments. A size range of the grains is preferably between 1.0 and 0.10 mm., most preferably about 0,230 mm. Preferably, the grains fill each of the subdivisions 38 to between about 90 and 100 percent, most preferably about 95 percent.

The compartments 26 are located and sized so that there is provided a balanced weight distribution symmetry of the grains 28 with respect to the glove body 22 along an axis of rotation defined along the trainee's forearm, which thereby allows for balanced hand movements by the trainee when wearing the martial arts training glove 20; this is particularly important in rolling hand movements associated with the martial arts, such as that associated with the "back fist hand strike". For example, the combined weight of the grains should be at least about one-half pound, and preferably be more-or-less around one pound.

With regard to the palm side heel compartment 26*a*, the following features are preferred to be present, as generally depicted by FIGS. 1, 2, 4, and 6. Three subdivisions 38 are provided. The length of the palm side heel compartment 26*a* is defined as follows: from adjacent the base of the thumb receptacle 24*e*(see FIG. 4), across the heel H of the glove body 22 and wrappingly around the bottom $B_t$ of the glove body to the back Ba of the glove body (see FIG. 2); the length is about 4 inches for a medium size glove body. The width of the palm side heel compartment is defined as follows: the width varies, being smallest at the thumb receptacle and greatest at the back of the glove body; the width is about 1.5 inches near the thumb receptacle and about 2 inches at the back of the glove body for a medium size glove body. The thickness T of each of the subdivisions 38 of the palm side heel compartment 26*a* is about 0.5 inches at maximum (see FIG. 6).

With regard to the back side compartment 26*b*, the following features are preferred to be present, as generally depicted by FIGS. 1, 2, 3, and 5. Two subdivisions 38 are provided. The length of the back side compartment **26*b* is defined as follows: from adjacent the index finger glove body seam 40 (see FIG. 3), across the back BA of the glove body to a demarcation 42 between the second (near index) and third finger receptacles 24*b*, 24*c* (see FIG. 1), with a convex curvature remote from the aforesaid receptacles; the length is about 2.5 inches (at other than the curvature) for a medium size glove body. The width of the back side compartment 26*b* is defined as follows: the width varies because of the aforesaid convex curvature, being smallest at the demarcation 42 and greatest at the index finger glove body seam 40; the width is about 3.5 inches near the demarcation 42 and about 5 inches at the index finger glove body seam 40 for a medium size glove body. It should be noted in this regard, that the back side compartment 26*b* extends into each of the truncated finger receptacles 24*a*, 24*b* about 0.75 inch. The thickness T' of each of the subdivisions 38 of the back side compartment 26*b* is about 0.5 inches at maximum (see FIG. 5**).

Figure 3:
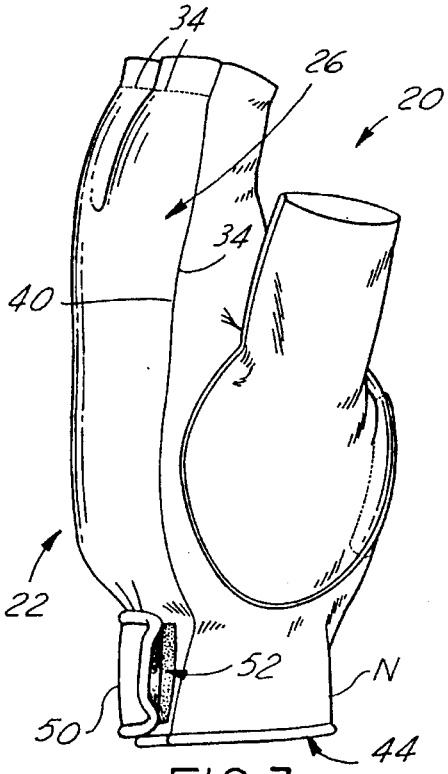
FIG. 3 is a thumb side view of the martial arts training glove according to the present invention.
Figure 4:
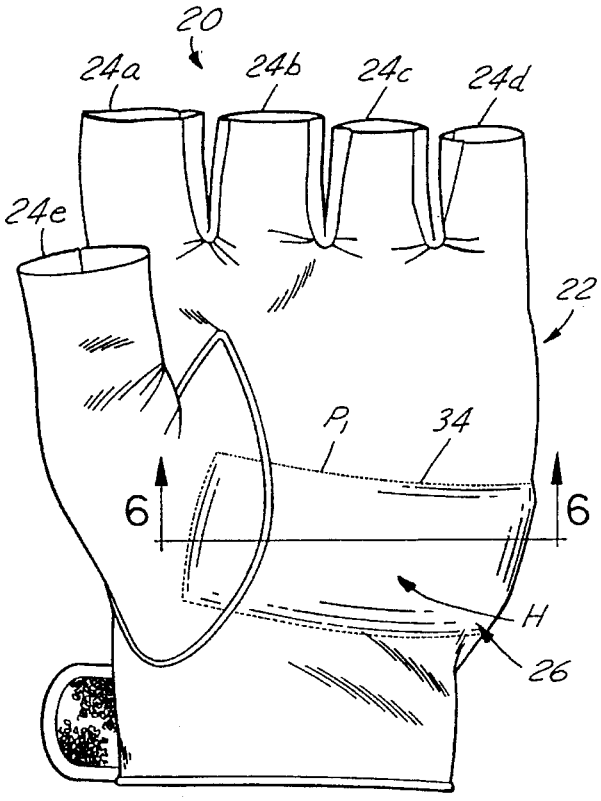
FIG. 4 is a palm side view of the martial arts training glove according to the present invention.
Figure 5:
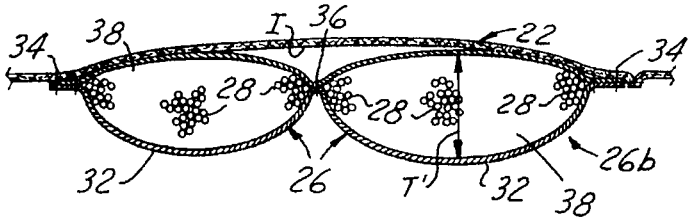
FIG. 5 is a partly sectional view of the martial arts training glove according to the present invention, seen along line 5—5 in FIG. 1.
Figure 6:
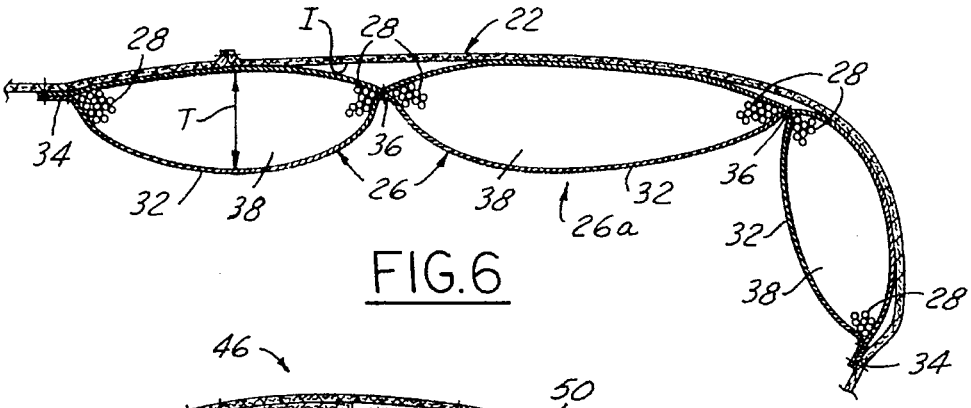
FIG. 6 is a partly sectional view of the martial arts training glove according to the present invention, seen along line 6—6 in FIG. 4.
Figure 7:
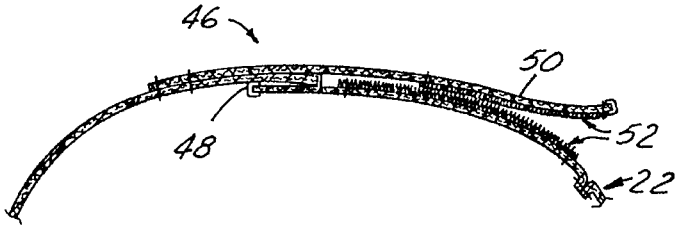
FIG. 7 is a partly sectional view of the martial arts training glove according to the present invention, seen along line 7—7 in FIG. 1.

As shown in FIGS. 1, 3 and 7, it is preferred for the hand opening 44 of the glove body 22 at the neck N thereof to be provided with a wrist cinch 46. A preferred wrist cinch is a slit 48 formed in the back BA of the glove body 22 at the opening 44 thereof, a strap 50 connected with one side of the slit, and a two component hook and loop fastener 52 (such as for example VELCRO, a trademark product of Velcro, U.S.A.), wherein one component thereof is provided on the strap and the other component thereof is provided on the glove body at the other side of the slit. In operation, the trainee would unfasten the strap, slip his or her hand into the glove body, then selectively tighten the glove body opening tightly about his or her wrist by pulling on the strap and pressing it onto the glove body to thereby close the slit and secure the two components of the hook and loop fastener.

Operation of the martial arts training glove 20 will now be detailed with reference being particularly directed to FIGS. 8 through 16. In this regard, there are at least five common martial arts hand strikes for which the martial arts training glove 20 is useful. The five common martial arts hand strikes are: "front knuckle hand strike" shown in FIG. 8; "back fist hand strike" shown in FIG. 9; "pseudo ridge hand strike" shown in FIG. 11; "open palm hand strike" shown in FIG. 13; and "ridge hand strike" shown in FIG. 15. How the martial arts training glove 20 is used with respect to each of these common hand strikes will sufficiently exemplify the advantageous operation of the present invention so as to enable those of ordinary skill in the relevant art to apply the present teachings to fabricate a martial arts training glove for accommodating other martial arts hand strikes.

1) Front Knuckle Hand Strike

Figure 8:
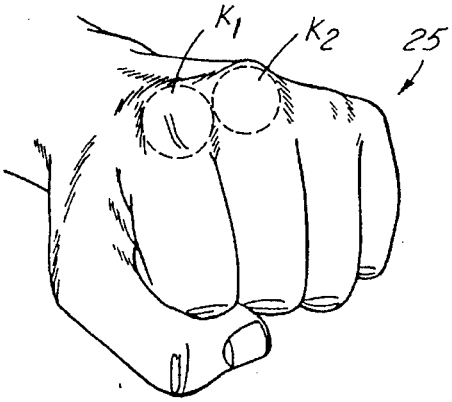
FIG. 8 is a depiction of a martial arts hand stance for providing a "front knuckle hand strike".
Figure 10:
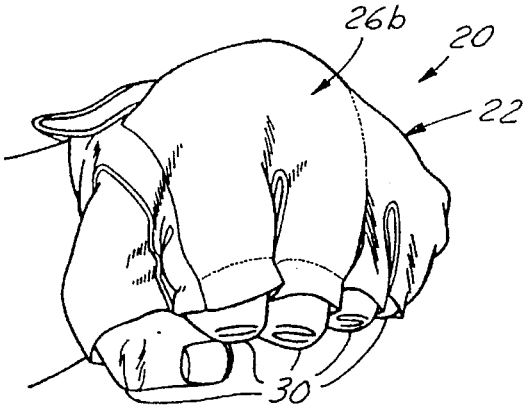
FIG. 10 shows the martial arts training glove according to the present invention in operation to provide hand protection for a "front knuckle hand strike" or a "back fist hand strike".

As indicated by comparison between FIGS. 8 and 10, the back side compartment **26*b* protects the index finger and near index finger first knuckles K1 and K2 at locations thereof at the front of the hand 25 in-line with the trainee's wrist from being hurt when the fist of the trainee is moved outwardly by outstretching the arm so as to impact these knuckles forwardly upon an object. Note also in FIG. 10 how the martial arts training glove 20** bendably allows for the trainee to form a completely natural fist.

2) Back Fist Hand Strike

Figure 9:
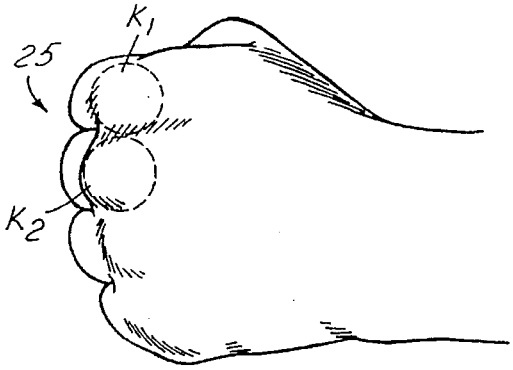
FIG. 9 is a depiction of a martial arts hand stance for providing a "back fist hand strike".

As indicated by comparison between FIGS. 9 and 10, the back side compartment **26*b* protects the index finger and near index finger first knuckles K1 and K2 at locations thereof at the back of the hand 25** from being hurt when the fist of the trainee is moved laterally with the back of the hand facing the movement so as to impact these knuckles upon an object.

3) Pseudo Ridge Hand Strike

Figure 11:
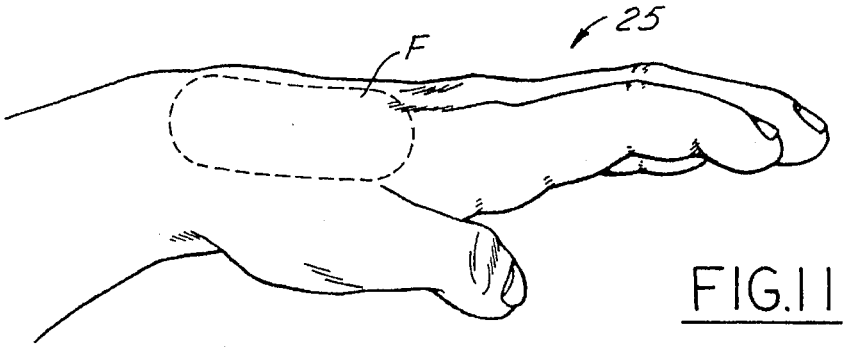
FIG. 11 is a depiction of a martial arts hand stance for providing a "pseudo ridge hand strike".
Figure 12:
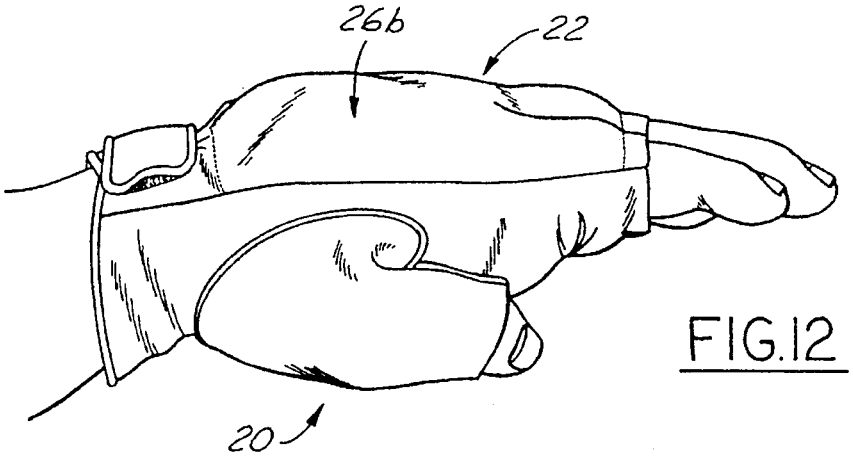
FIG. 12 shows the martial arts training glove according to the present invention in operation to provide hand protection for a "pseudo ridge hand strike".

As indicated by comparison between FIGS. 11 and 12, the back side compartment **26*b* protects the metacarpus bone of the index finger in the area F below the index finger first knuckle from being hurt when the flatly open hand 25 of the trainee is moved laterally with area F facing the movement so as to impact this area upon an object. Note also in FIG. 12 how the martial arts training glove 20** bendably allows for the trainee to close his or her thumb against the index finger knuckle in a completely natural way.

4) Open Palm Hand Strike

Figure 13:
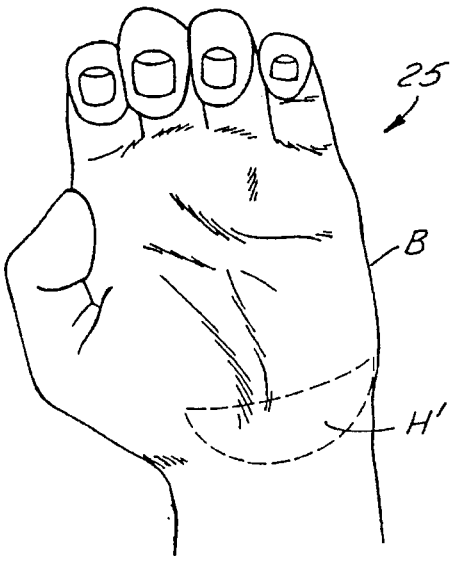
FIG. 13 is a depiction of a martial arts hand stance for providing an "open palm hand strike".
Figure 14:
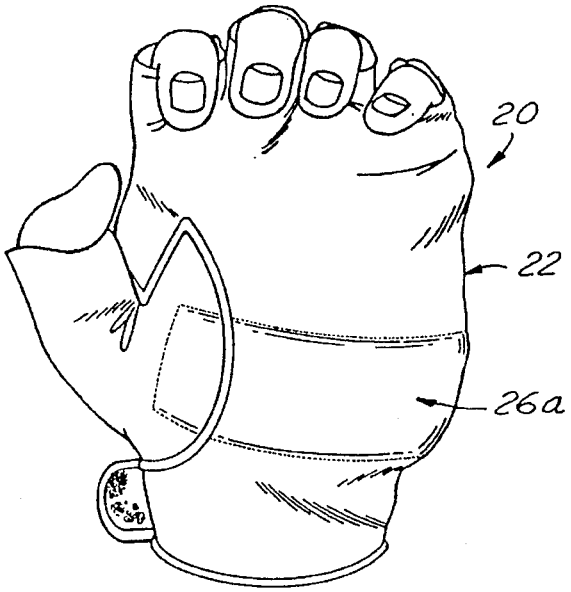
FIG. 14 shows the martial arts training glove according to the present invention in operation to provide hand protection for an "open palm hand strike".

As indicated by comparison between FIGS. 13 and 14, the palm side heel compartment **26*a* protects the palm heel H' of the trainee's hand 25 from being hurt when the hand of the trainee is moved outwardly in a movement, wherein the palm heel is aligned with the forearm, so as to impact the palm heel upon an object. Note also in FIG. 14 how the martial arts training glove 20** bendably allows for the trainee to curve the second and third knuckles of each of the fingers and the first and second knuckles of the thumb in a completely natural way.

5) Ridge Hand Strike

Figure 15:
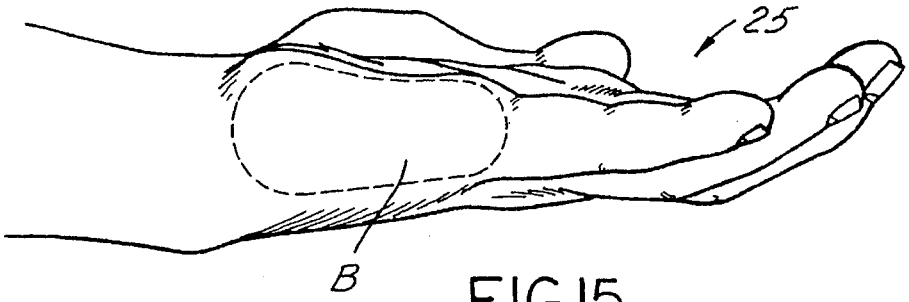
FIG. 15 is a depiction of a martial arts hand stance for providing a "ridge hand strike".
Figure 16:
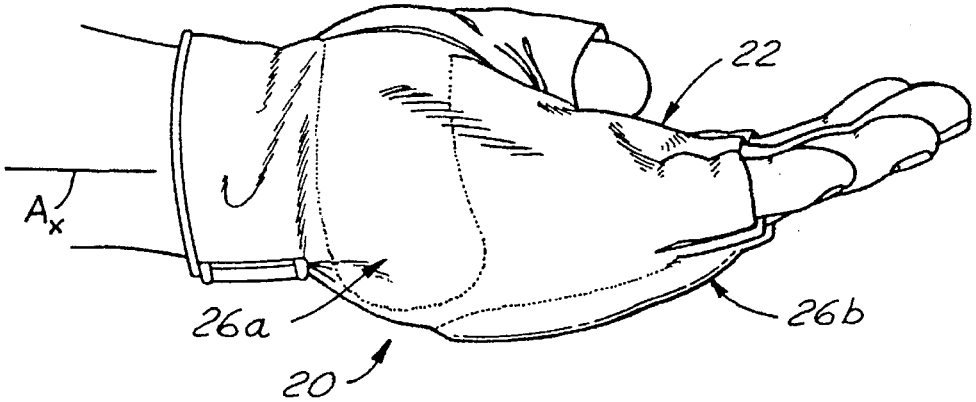
FIG. 16 shows the martial arts training glove according to the present invention in operation to provide hand protection for a "ridge hand strike".

As indicated by comparison between FIGS. 15 and 16, the palm side heel compartment **26*a* protects the bone of the bottom B of the trainee's hand from being hurt when the flatly open hand 25 of the trainee is moved so as to impact the bottom of the hand upon an object. Note also in FIG. 16 how the martial arts training glove 20** bendably allows for the trainee to open his or her fingers with the thumb in close to the index finger in a completely natural way.

Figure 17:
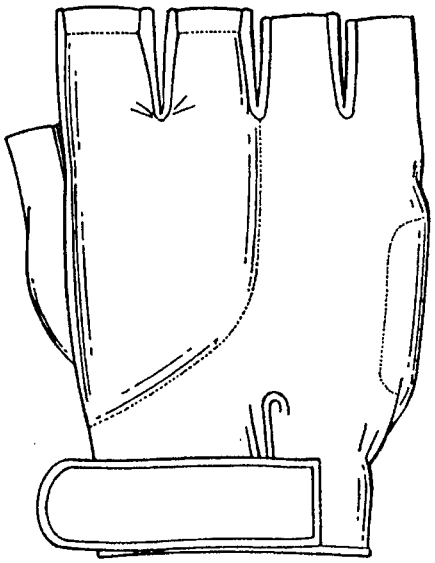
FIGS. 17 and 18 depict views of a right hand martial arts training glove similar to that of the left hand martial arts training glove shown in FIGS. 1 and 4, respectively.
Figure 18:
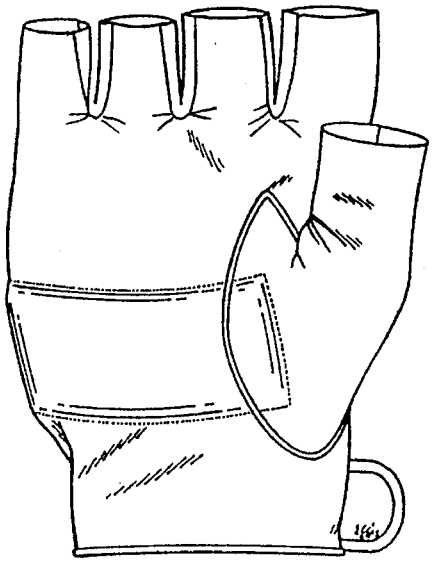

It is to be understood that while a left hand martial arts training glove 20 has been shown and described herein, that the description hereinabove pertains equally to a right hand martial arts training glove, as depicted in FIGS. 17 and 18.

It is to be further understood that it is the intention of the present invention to adjust the placement and size of at least one granular material filled compartment per the teachings herein to thereby properly adapt the martial arts training glove accoriling to the present invention to protect the hand of the trainee from martial arts hand strikes other than the five common hand strikes described hereinabove.

While not preferred as this may restrict free wrist movement during martial arts hand movements, a wrist wrap may be included with the martial arts training glove which interconnects with the neck N of the glove body, such as by a hook and loop fastener, to thereby simultaneously wrap tightly about the neck and the wrist of the trainee.

To those skilled in the art to which this invention appertains, the above described preferred embodiment may be subject to change or modification. For example, the finger and thumb receptacles of the glove body may be complete and not truncated. Such change or modification can be carried out without departing from the scope of the invention, which is intended to be limited only by the scope of the appended claims.

What is claimed is:

1. A martial arts training glove for protecting a hand of a user during martial arts hand strikes wherein the hand impacts with an object, said martial arts training glove comprising:

a glove body, said glove body having a neck, an opening at said neck, an index finger receptacle, a near index finger receptacle, a third finger receptacle, a fourth finger receptacle, a thumb receptacle, a palm side, a heel at said palm side, a back side opposite said palm side, a thumb side, a bottom side opposite said thumb side, and an interior side;

at least one compartment connected with said glove body, said at least one compartment being sealed closed, wherein said at least one compartment is located at least at said heel, said bottom side and said back side of said glove body; and loose granular material located within said at least one compartment.

2. The martial arts training glove of claim 1, further comprising cinch means connected with said glove body at said neck thereof for tightening said neck about a wrist of the user.

3. The martial arts training glove of claim 1, wherein said index, near index, third, fourth finger receptacles and said thumb receptacle are each truncated.

4. The martial arts training glove of claim 1, wherein said loose granular material comprises a plurality of substantially nondeformable grains, said grains having a size ranging between substantially 1.0 and 0.10 mm.

5. The martial arts training glove of claim 4, wherein said glove body is leather and said grains are metallic.

6. The martial arts training glove of claim 4, wherein said grains fill substantially between 90 and 100 percent of said at least one compartment.

7. The martial arts training glove of claim 6, wherein said grains fill substantially 95 percent of said at least one compartment.

8. The martial arts training glove of claim 6, wherein said at least one compartment is connected with said interior side of said glove body.

9. The martial arts training glove of claim 8, wherein said at least one compartment is composed of a material suitable for lining a glove interior.

10. The martial arts training glove of claim 1, wherein said at least one compartment comprises:

a palm side heel compartment located at each of said heel and said bottom side of said glove body; and a back side compartment located at said back side of said glove body.

11. The martial arts training glove of claim 10, wherein said grains are positioned by said palm side heel compartment and said back side compartment so that said grains have a substantially symmetrical and substantially balanced weight distribution with respect to said glove body.

12. The martial arts training glove of claim 11, further comprising:

first subdivision means for providing at least two first subdivisions of said palm side heel compartment for trapping said grains exclusively within each of said at least two first subdivisions; and second subdivision means for providing at least two second subdivisions of said back side compartment for trapping said grains exclusively within each of said at least two first subdivisions.

13. The martial arts training glove of claim 12, wherein said palm side heel compartment has a first periphery whereat said palm side heel compartment is connected with said glove body; and wherein said back side compartment has a second periphery whereat said palm side heel compartment is connected with said glove body.

14. The martial arts training glove of claim 13, further comprising cinch means connected with said glove body at said neck thereof for tightening said neck about a wrist of the user; and wherein said index, near index, third, fourth finger receptacles and said thumb receptacle are each truncated.

15. A martial arts training glove for providing weight training for martial arts hand movements and for protecting a hand of a user during martial arts hand strikes wherein the hand impacts with an object, said martial arts training glove comprising:

a glove body, said glove body having a neck, an opening at said neck, an index finger receptacle, a near index finger receptacle, a third finger receptacle, a fourth finger receptacle, a thumb receptacle, a palm side, a heel at said palm side, a back side opposite said palm side, a thumb side, a bottom side opposite said thumb side, and an interior side;

at least one compartment connected with said interior side of said glove body, said at least one compartment being sealed closed, wherein said at least one compartment is located at least at said heel, said bottom side and said back side of said glove body; and loose granular material located within said at least one compartment, wherein said loose granular material comprises a plurality of metallic grains, said grains having a size ranging between substantially 1.0 and 0.10 mm.

16. The martial arts training glove of claim 15, wherein said at least one compartment comprises:

a palm side heel compartment located at each of said heel and said bottom side of said glove body; and a back side compartment located at said back side of said glove body.

17. The martial arts training glove of claim 16, wherein said grains provide a combined weight of at least substantially one-half pound; wherein said grains are positioned by said palm side heel compartment and said back side compartment so that said grains have a substantially symmetrical and substantially balanced weight distribution with respect to said glove body.

18. The martial arts training glove of claim 17, further comprising:

first subdivision means for providing at least two first subdivisions of said palm side heel compartment for trapping said grains exclusively within each of said at least two first subdivisions; and second subdivision means for providing at least two second subdivisions of said back side compartment for trapping said grains exclusively within each of said at least two first subdivisions.

19. A martial arts training glove for proving weight training for martial arts hand movements and for protecting a hand of a user during martial arts hand strikes wherein the hand impacts with an object, said martial arts training glove comprising:

a glove body, said glove body having a neck, an opening at said neck, an index finger receptacle, a near index finger receptacle, a third finger receptacle, a fourth finger receptacle, a thumb receptacle, a palm side, a heel at said palm side, a back side opposite said palm side, a thumb side, a bottom side opposite said thumb side, and an interior side, wherein said index, near index, third, fourth finger receptacles and said thumb receptacle are each truncated;

at least one compartment connected with said interior side of said glove body, said at least one compartment being sealed closed, wherein said at least one compartment is located at least at said heel, said bottom side and said back side of said glove body;

loose granular material located within said at least one compartment, wherein said loose granular material comprises a plurality of metallic grains having a collective weight of at least substantially one-half pound, said grains having a size ranging between substantially 0.1 and 1.0 mm.

cinch means connected with said glove body at said neck thereof for tightening said neck about a wrist of the user;

wherein said grains are positioned by said palm side heel compartment and said back side compartment so that said grains have a substantially symmetrical and substantially balanced weight distribution with respect to said glove body.

* * * * *